United States Patent [19]

Martelli

[11] 4,217,469

[45] Aug. 12, 1980

[54] CODING AND DECODING APPARATUS FOR THE PROTECTION OF COMMUNICATION SECRECY

[76] Inventor: Emilio Martelli, 18 Upper Addison Gardens, London W14, England

[21] Appl. No.: 885,214

[22] Filed: Mar. 10, 1978

[30] Foreign Application Priority Data

Mar. 15, 1977 [CH] Switzerland ..... 3222/77
May 25, 1977 [CH] Switzerland ..... 6455/77

[51] Int. Cl.[2] ..... H04K 1/06
[52] U.S. Cl. ..... 179/1.5 R; 375/2
[58] Field of Search ..... 179/1.5 R; 178/22

[56] References Cited

U.S. PATENT DOCUMENTS

| | | | |
|---|---|---|---|
| 2,913,525 | 11/1959 | Larsen | 179/1.5 R |
| 3,105,114 | 9/1963 | Koenig, Jr. | 179/1.5 R |
| 3,657,699 | 4/1972 | Rocher | 178/22 |
| 3,731,197 | 5/1973 | Clark | 178/22 |
| 3,773,977 | 11/1973 | Guanella | 179/1.5 R |
| 3,824,467 | 7/1974 | French | 179/1.5 R |
| 3,937,888 | 2/1976 | Myers | 179/1.5 R |
| 4,086,435 | 4/1978 | Graupe et al. | 179/1.5 R |
| 4,087,626 | 5/1978 | Brader | 178/22 |
| 4,100,374 | 7/1978 | Jayant et al. | 179/1.5 R |

*Primary Examiner*—Howard A. Birmiel
*Attorney, Agent, or Firm*—Cooper, Dunham, Clark, Griffin & Moran

[57] ABSTRACT

Apparatus for coding and decoding of electrical signals within a pre-established frequency band and useful for providing communication secrecy. A transmission and coding circuit and a reception and decoding circuit is provided between means for the generation and reception of electrical signals and means for the exchange of coded signals with at least one other coding and decoding apparatus. Commutation means is utilized for complementarily enabling the circuits. The circuits include first means for temporarily storing consecutively received portions of the electrical signals, second means for enabling the operation of the first means to consecutively store in memory the signal portion and to transmit those signal portions in a different order, and third means for controlling the storage of the electrical signal portions in memory within the first means according to one of a fixed sampling frequency and two or more frequencies variable in a prestablished order.

42 Claims, 5 Drawing Figures

CODING AND DECODING APPARATUS FOR THE PROTECTION OF COMMUNICATION SECRECY

BACKGROUND AND BRIEF DESCRIPTION OF THE INVENTION

The present invention relates to apparatus for the coding and decoding of electrical signals within a pre-established frequency band, for the protection of communication secrecy, which may be connected between means for the generation and reception of the electrical signals and means for the exchange of the coded signals with at least one other coding and decoding apparatus.

Communication systems are known which code a transmitted signal and decode a received signal, generally a signal within the voice band, which provide for the protection of communication secrecy by acting either in the frequency domain by inversions and translations of the transmitted signal or in the time domain by sampling and temporarily storing in memory subsequent fragments of the transmitted signal and sending later these fragments on a communication line according to a pseudo-random order. More particularly, in this latter type of apparatus, the phonic signal, after sampling, is generally converted from analog-to-digital form and sent to different logic memory registers. From these registers the signal, after extraction and reconversion from digital to analog form, is sent on the communication line through a control proceeding from a code generator which selects the registers according to a variable sequence having a repetition period very high with respect to the short lapses of time encountered in a radio of telephonic communication, so that the selection is substantially random.

At the present time, apparatus of this type, while appreciably improving the secrecy of communications present some drawbacks which limit performance. As examples, first, the code generator has no control over the register selection sequence, and hence the same register may be selected many times in succession, the fragments of the phonic signal contained in the register being consequently transmitted in their natural order, and the signal transmission may thus be "clear" for short periods. Second, to allow a correct decoding of the transmitted signal, the code generator of the receiving apparatus must necessarily be synchronized with the code generator of the transmitting apparatus with which it is communicating. This synchronizing operation is repeated, in known apparatus, each time it is desired to reverse the communication sense between the users; therefore, in a transmission system with more than two units in different places connected at the same time, the non-reception of a synchronizing signal will cause the disabling for reception of one or more receiving units. Third, the changing from the transmission of a non-coded ("clear") signal, to the transmission of a coded signal requires manual operations for the adaptation of the units by all users, so that use of the units is not simple. Fourth, known units essentially operate in simplex, i.e., with a single active transmission and reception channel, even if the communication line is of the duplex type and would allow the simultaneous communication in the two directions of the line. Hence, it would be particularly advantageous to utilize such a line in a complete way, to permit duplex communication similar to that between two conventional telephones. Finally, such known apparatus is relatively costly, due to the number and the cost of individual electronic components used, and hence the widespread use of such systems is limited.

Accordingly, an object of the present invention is to provide coding and decoding apparatus, operating in the time domain, for the protection of communication secrecy, which obviates the above drawbacks and permits further frequency coding of a phonic signal, which is easily and quickly installed and simple to use, particularly in a telephone line or radio relay link, and which may be provided as a portable unit which results in cost reduction compared with units presently available, while still maintaining high security and good communication quality.

According to the present invention, there is provided apparatus for the coding and decoding of electrical signals within a pre-established frequency band for the protection of communication secrecy, which may be connected between means for the generation and reception of the electrical signals and means for the exchange of the coded signals with at least one other coding and decoding apparatus. Such apparatus comprises a transmission and coding circuit and a reception and decoding circuit for the signals, with an operation complementarily enabled by commutation means. The circuits include first means, preferably having a plurality of memory elements, for temporarily storing consecutively received portions of the electrical signals, and second means for enabling operation of the first means to consecutively store in memory the signal portions and to send them, according to a different order, to the exchange means or to the means for the reception of the signals. Third means may be included for storing the electrical signals portions within the first means according to a fixed sampling frequency or to two or more variable frequencies in a pre-established order.

Presently preferred embodiments of the invention will now be described, only as an example, and with reference to the accompanying drawings.

DETAILED DESCRIPTION

Figure 1A:
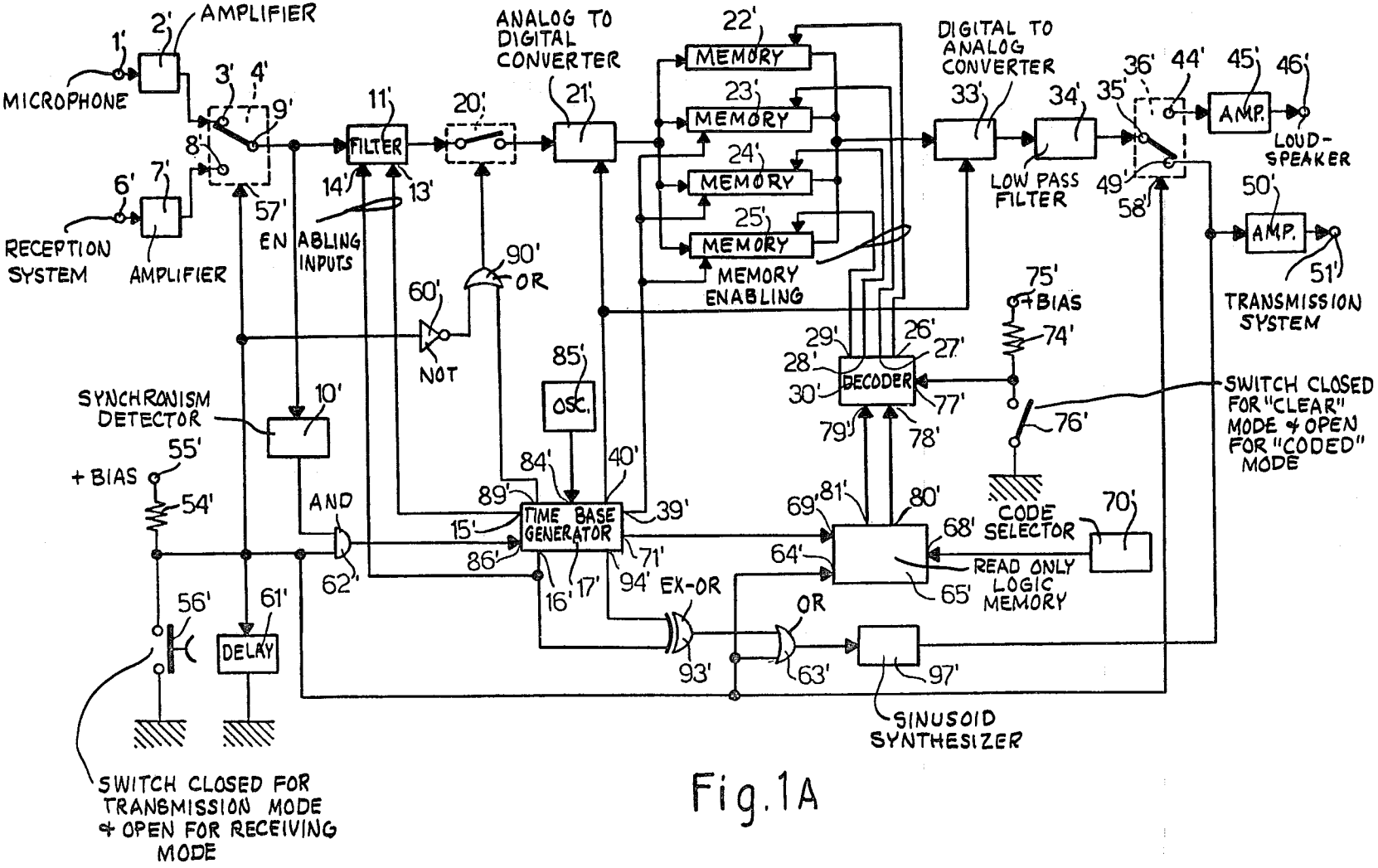
FIG. 1A is a block diagram of a system embodying the present invention.

With reference to FIG. 1A, a microphone terminates at a connection terminal 1', which is connected through an amplifier 2', having adjustable input impedance and gain, to a first exchange terminal 3' of an electronic switch 4', provided e.g. by a C/MOS component. The output of a reception system, e.g., of a radiotelephone (not shown) terminates at a connection terminal 6', which is connected through an amplifier 7' having adjustable input impedance and gain, to a second exchange terminal 8' of switch 4'. Within that switch, common terminal 9' is connected to inputs of a synchronism detecting block 10' and a band-eliminating filter 11'. Particularly, the filter 11' is provided with a very narrow band, centered to a frequency value of 1600 Hz, e.g., and is of the type comprising a plurality of capacitors having a first armature connected together, forming the filter input, and a second armature alternatively connectable to the same filter output through an electronic commutator. Such a filter is known as a "commutation filter" or "N-PATH-FILTER".

Signals arrive at enabling inputs 13' and 14' of filter 11', respectively from the outputs 15' and 16' of time base generator 17' provided, e.g., by a chain of dividers. Particularly, a logic signal is applied to input 13' of filter 11' which controls the speed of the electronic commutator therein, while a logic signal for controlling the scanning direction of the commutator is applied to input 14'.

An output of filter 11' is connected through an electronic switch 20' to a signal input of an analog-to-digital converter 21', having an output connected to the signal inputs of logic memories 22', 23', 24' and 25'. These memories have enabling inputs respectively connected to outputs 26', 27', 28' and 29' of a decoding block 30'. The outputs of memories 22', 23', 24' and 25' are connected together, and through a digital-to-analog converter 33', they are connected to the input of a low-pass filter 34' having, preferably, a cut-off frequency of 3 KHz, e.g. The output of filter 34' is applied to a common terminal 35' of an electronic switch 36', preferably formed with a C/MOS component. Further, memories 23', 24' and 25' are provided with clock inputs connected to an output 39' of the time base generator 17'. Output 40' of that generator is applied to the clock inputs of the analog-to-digital and the digital-to-analog converters 21' and 33'.

A first exchange terminal 44' of the electronic switch 36' is connected to the input of an amplifier 45', whose output is connected to a terminal 46', externally connectable with a loud-speaker (not shown). A second exchange terminal 49' of the electronic switch 36' is connected to the input of an amplifier 50' having adjustable output impedance and gain, and which is connected to an input of a transmission system, e.g., a radiotelephone (not shown) through a connection terminal 51'.

A resistor 54' has a first end connected to a terminal 55' of a bias source, e.g., of positive potential, and a second end connected to a terminal of a push button switch 56' of the normally open type, the other terminal of which is connected to ground. When the switch 56' is actuated to provide for transmission or reception, enabling signals are applied to control inputs 57' and 58' of switches 4' and 36', to an input of a logic gate 60' of the NOT type, to an input of a delay block 61' having a grounded terminal, to a first input of logic AND gate 62' and OR gate 63', and to an input 64' of a read only logic memory 65' of the type programmable from the exterior (PROM).

A signal from a code selection block 70' and a clock signal coming from an output 71' of the time base generator 17' are coupled to respective inputs 68' and 69' of memory 65'.

A resistor 74' has a first end connected to a terminal 75' of the above mentioned bias source and a second end connected to a terminal of a switch 76' having its other terminal grounded and suitable, particularly, to allow the apparatus to operate in "clear" or in "code" mode. The resistor 74' is also connected to an input 77' of the decoding block 30', whose inputs 78' and 79' receive output signals from ouputs 80' and 81' of memory 65'. An input 84' of the time base generator 17' is connected to an output of an oscillator 85' of the quartz crystal type, e.g., while a synchronization input 86' of that generator receives a signal from one output of AND gate 62'. A second input of the gate 62' is connected to an output of the synchronism detecting block 10'. An output 89' of the time base generator 17' is connected to a first input of a two logic gate 90' of the OR type, having a second input connected to the output of the NOT gate 60' and an output connected to a control input of the electronic switch 20'.

The output 16' of the time base generator 17', connected to input 14' of filter 11', is also connected to a first input of a two input logic gate 93' of the EX - OR type at whose second input signal 94' is received from the time base generator 17'. The output of the EX - OR logic gate 93' is coupled to a second input of the OR logic gate 63' whose output is coupled to the input of amplifier 50' through a sinusoid synthesizer 97'. The synthesizer may comprise, e.g., a digital-to-analog converter and is suitable to provide a synchronism signal at a frequency of 1600 Hz, e.g.

The operation of the above apparatus according to the present invention will be explained with respect to the two communication modes, "clear" and "code". It should be noted that there is an individual system, such as shown in FIG. 1A, for each user.

Assume a connection between two users in the "clear" mode, accompanied by actuation by both users of the corresponding switch 76' of each system so as to maintain grounded the input 77' of decoder 30' in the system of each, and the transmitting user keeping depressed the push button switch 56'.

In both the transmitting and the receiving systems, the grounded input 77' of decoder 30' maintains at a level "0"the outputs 27', 28', and 29' and at a level "1" the outputs 26' of the decoder, thereby enabling only memory 22' which introduces zero signal delay between the input and the output of each system.

In the transmitting system, through push button switch 56', inputs 57' and 58' of electronic switches 4' and 36' are connected to ground and determine consequently the connection between terminals 35' and 49' of switch 36' and terminals 3' and 9' of switch 4'. The first input of AND gate 62' is also kept grounded, and the output of this gate is consequently at a "0" level, which prevents the transmission of an output signal from the synchronism detector 10' to the input 86' of the time base generator 17'. Thereby, the time base generator 17' is energized, only by oscillator 85' and sends control signals to inputs 13' and 14' of filter 11', through its own outputs 15' and 16'. The filter 11' eliminates therefore the phonic signal arriving at its signal input and which results comprised within the mentioned band around 1600 Hz.

Coincidentally with a rotation direction change in the filter 11', the time base generator 17', through output 89', sends during some milliseconds a signal at a "0" level to the first input of OR gate 90', whose output however is always at level "1"; in effect, the second input of OR gate 90' is kept at level "1" by the output of NOT gate 60', whose input is grounded through the push button switch 56'. The control input of the electronic switch 20' remains therefore at the "1" level and keeps the switch permanently closed.

The time base generator 17' also sends clock signals to converters 21' and 33', to memories 23', 24' and 25' and to the logic memory 65'; and further a signal is sent continuously to the synthesizer 97' through EX - OR gate 93' and the subsequent OR gate 63'. The synthesizer provides, at its output, the above-mentioned synchronism sinusoidal signal at 1600 Hz, e.g., whose phase is periodically reversed through 180°, e.g., at each second, by the signal coming from output 16' of the time base generator 17'. Lastly, a first operation cycle of memory 65' is enabled, through its input 64' which is grounded by push button switch 56'. Such an operation has no consequences on the remainder of the circuit, because outputs 80' and 81' of memory 65' are coupled respectively to inputs 78' and 79' of the decoder 30', whose operation is disabled by the signal arriving at its input 77' by grounded switch 76', as noted above.

Therefore, the phonic signal from the microphone of the transmitting user connected to terminal 1' is coupled to the reception system of the receiving user through amplifier 2', terminals 3' and 9' of switch 4', filter 11', switch 20' analog-to-digital converter 21', memory 22', digital-to-analog converter 33', low pass filter 34', terminals 35' and 49' of switch 36', amplifier 50', at whose input it adds to the synchronism signal coming from the synthesizer 97', and terminal 51' connected to the radiotelephone, e.g., which form together a transmission circuit transmitting signals in the "clear" mode.

In the receiving apparatus, the corresponding push button 56' is open, whereby a signal at level "1" is present at inputs 57' and 58' of switches 4' and 36', and determines respectively the connection between terminals 8' and 9' of switch 4' and between terminals 35' and 44' of switch 36'. The signal at level "1" allows further the transmission of the synchronism signal from the output of the detector 10' to the input 86' of the time base generator 17', through AND gate 62', and disables the operation of synthesizer 97' because the output of OR gate 63' is permanently forced at level "1". The time base generator 17' of the receiving apparatus energized by oscillator 85' and synchronized with the transmitting apparatus sends (in an analogous way to the transmitting apparatus, described above) control signals to filter 11' and to the electronic switch 20'. The filter 11' operates as already described, while the output of NOT gate 60', at level "0", allows the passage of the control signal from output 89' of the time base generator 17' to the control input of switch 20', through OR gate 90'. That control signal, at level "0" during some milliseconds after the instant of the rotation inversion of filter 11', determines, in this short period, the opening of switch 20'. In this way, a momentary widening of the synchronism signal spectrum, during the phase inversion of the same by the transmitting apparatus, is substantially compensated for by both the inversion of the filter 11' rotation, and the further opening of switch 20', thus obtaining in the whole a remarkable attenuation of the signal at 1600 Hz., e.g. From the time base generator 17', clock signals are further sent to converters 21' and 33', to memories 23', 24' and 25' and to the logic memory 65, wherein a second operating cycle is enabled through the input 64' at level "1". In this case also, as with the transmitting apparatus, there are no consequences on the remainder of the circuit.

Therefore, the phonic signal from the reception system, connected to terminal 6' of the receiving user, passes through terminals 8' and 9' of switch 4', filter 11', switch 20', the analog-to-digital converter 21', memory 22', the digital-to-analog converter 33', low pass filter 34', terminals 35' and 44' of switch 36', amplifier 45', which form all together a reception circuit, and arrives at terminal 46' connected to the loudspeaker.

An inversion of the communication direction between the two users is possible when the transmitting user releases his push button switch 56' and the receiving user depresses the corresponding push button switch 56', whereby a complete exchange of the functions described in the two units is achieved. Particularly, the "0" level derived from the actuation of push button switch 56' is kept for some hundreds of milliseconds (e.g., 300 m sec) by the delay block 61' in the transmitting apparatus, in order to permit the emptying of the contents of memories 23', 24' and 25' which, however, in this case are already free. Furthermore, as the period of the signal present at the output 16' of the time base generator 17' is of one second, e.g., and this signal determines the phase inversion of the sinusoid provided by the synthesizer 97' of the transmitting apparatus and hence the period of the synchronizing signal at the output of the receiving apparatus detector 10', the maximum time within which the two units in connection become synchronized after an inversion of the commuication sense, is substantially contained within two seconds, e.g.

The change from communication in "clear" mode to the "coded" mode occurs by opening the switch 76' in each unit. This actuation permits the disengagement of outputs 26', 27', 28' and 29' of decoder 30', which from the moment of switch actuation, assume a level "1" when the pairs of binary numbers 00, 01, 10, 11 are present at the inputs 78' and 79' of the decoder from the logic memory 65'. The outputs 26', 27', 28' and 29' consequently enable the operation of respective memories 22', 23', 24' and 25' associated therewith, with the consequent transmission in line (terminal 51') or the loudspeaker (terminal 46') of the fragments of the phonic signals contained in the memories, and storing in memory of new phonic signal fragments coming from microphone (terminal 1') or from the reception system (terminal 6').

Memory 65' contains particularly at least one pair of sequences comprising each one the same number of the above-mentioned pairs of binary numbers, e.g., sixteen pairs, which are progressively and cyclically provided at outputs 80' and 81' of memory 65' due to the control of the clock signal arriving at the input 69' of the memory. The use of each sequence is enabled through the signal at level "0" or level "1" determined by the closed or open position of push button switch 56' and present at the input 64' of memory 65', so as to utilize a first sequence for the transmitting apparatus and a second sequence for the receiving apparatus; furthermore, in the case where memory 65' may contain more sequence pairs, the particular pair may be selected exteriorly through the code selector 70'.

The sequence relative to the transmitting apparatus, while assuming substantially in time a random state, is subjected to three constraints: the first due to the fact that a phonic signal fragment must have a total delay in the transmitting and receiving apparatus not greater than six steps, e.g., of the clock signal present at the output 71' of the time base generator 17', the second due to the fact that a good coding of the phonic signal requires that fragments of the signal, consecutively stored by the memories of the transmitting apparatus, must not be transmitted consecutively; and the third is due to the fact that the sequence must be cyclically repeatable, whereby the number pairs emitted at the end of the sequence must be compatible with those emitted at the beginning of the same sequence in order to allow a decoding without discontinuities in the receiving apparatus.

Therefore, the subsequent phonic signal fragments coming from the microphone of the transmitting apparatus, rest each one within one of memories 22', 23' 24' or 25' for a time period different with respect to the preceding fragment but not greater than the time period defined by the six steps, e.g., of the clock signal, and from the memories they are thereafter sent in line together with the synchronism signal at 1600 Hz, e.g. provided by the synthesizer 97'.

The sequence relative to the receiving apparatus must instead comprise one set of binary number pairs suitable to enable the operation of each memory 22', 23', 24' and 25' so that each fragment of phonic signal tramsmitted with a delay which is variable from zero to five clock steps, e.g., is further delayed in the receiving apparatus by a number of clock steps corresponding to the complement to six, e.g., of the delay received in the transmitting apparatus.

In conclusion, the phonic signal arrives, from the transmitting user microphone to the loudspeaker of the receiving apparatus with a total delay substantially equal to the above-mentioned six clock steps, e.g., increased by the propagation time along the transmission line.

The binary number pairs relative to the two sequences and satisfying the above-mentioned constraints, are established separately, e.g., by means of a computer, and as the sequence relative to the transmitting apparatus is cyclic, it may be begun by starting from any of the pairs of the binary numbers contained therein. Consequently, a sequence comprising a number N of binary number pairs and having the three above-mentioned requisites, orginates N different coding modes for the phonic signal transmitted independent of one another and which may be selected by the user, e.g., through block 70'.

For a correct operation of the coding and decoding, the sequences relative to the transmitting and receiving apparatus must evolve in a synchronous mode. Such a function is provided by the transmission of the synchronism signal at 1600 Hz, e.g., from the transmitting system as described with reference to the operation in the "clear" mode. The operation of filter 11', electronic switch 20' and delay block 61' occurs in an analogous mode which permits, as described, the emptying of the memories 23', 24', 25' after the release of push button switch 56' by the transmitting user before the engagement of the same memories by the signal incoming from the user which passes to transmission.

From the above description, it is seen how apparatus according to the present invention solves the coding of a phonic signal in the time domain, in a reliable manner and with a minimum number of components. Particularly, the use of a coding sequence of the cyclic type results, with only set of N binary number pairs opportunely selected, in N coding systems different one from another which occupy a minimum zone within memory 65'. This memory, which may readily be found on the market and at a low cost, may also be replaced by an analogous memory containing different sequences of binary number pairs. In this fashion, a possible undesired discovery of the coding system may be annuled by simply substituting one memory 65' for another. Further, the access to memory 65', generally indicated in the drawing by the code selecting block 70', may be obtained by sealed selectors, punched or magnetic cards or other methods, in order to further increase the secrecy on the particular paid of coding and decoding sequences used.

In the above communication system, a synchronism signal is transmitted substantially each second to the time base generator 17' of each receiving apparatus. This periodicity provides a perfect alignment between the sequences provided by the memories 65', permits any user to communicate with other users who are already in communication with each other and to be synchronized with them in the maximum time of two seconds, e.g., following the switch-on instant of the particular system. This particular feature remarkably increases the flexibility of the system compared with coding apparatus of known types wherein the synchronism signal is transmitted only one time by the transmitting apparatus at the beginning of the sequence provided by the relative code generator and renders impossible a subsequent synchronization with other users desiring to listen. Further, the synchronizing signal at 1600 Hz, e.g., adds to the phonic signal, with which it is transmitted in a continuous mode along the communication line and contributes to increase the security of the communication system since it originates a masking note.

The filter 11' is used in a manner particularly important: in effect, its control is effected through the time base generator 17', whereby its stability is proportional to that of oscillator 85' and further, in the receiving apparatus, it is not affected by possible frequency drifts of the synchronism signal provided by the synthesizer 97' of the transmitting apparatus, because the same synchronism signal also arrives to the time base generator of same receiving apparatus. Furthermore, the inversion of the commutation sense of filter 11' and the use of the electronic switch 20' allow, in the whole, a considerable improvement of filter performance.

The particular time division coding system does not widen in substance the band of the phonic signal transmitted, whereby it is possible to utilize any type of radio channel or telephone channel.

Lastly, the possible adjustment of the input impedance and the gain of amplifiers 2' and 7' and the output impedance and the gain of amplifier 50', renders systems in accordance with the present invention adaptable to any type of microphone and radiotelephone, thereby increasing flexibility in use.

Figure 1B:
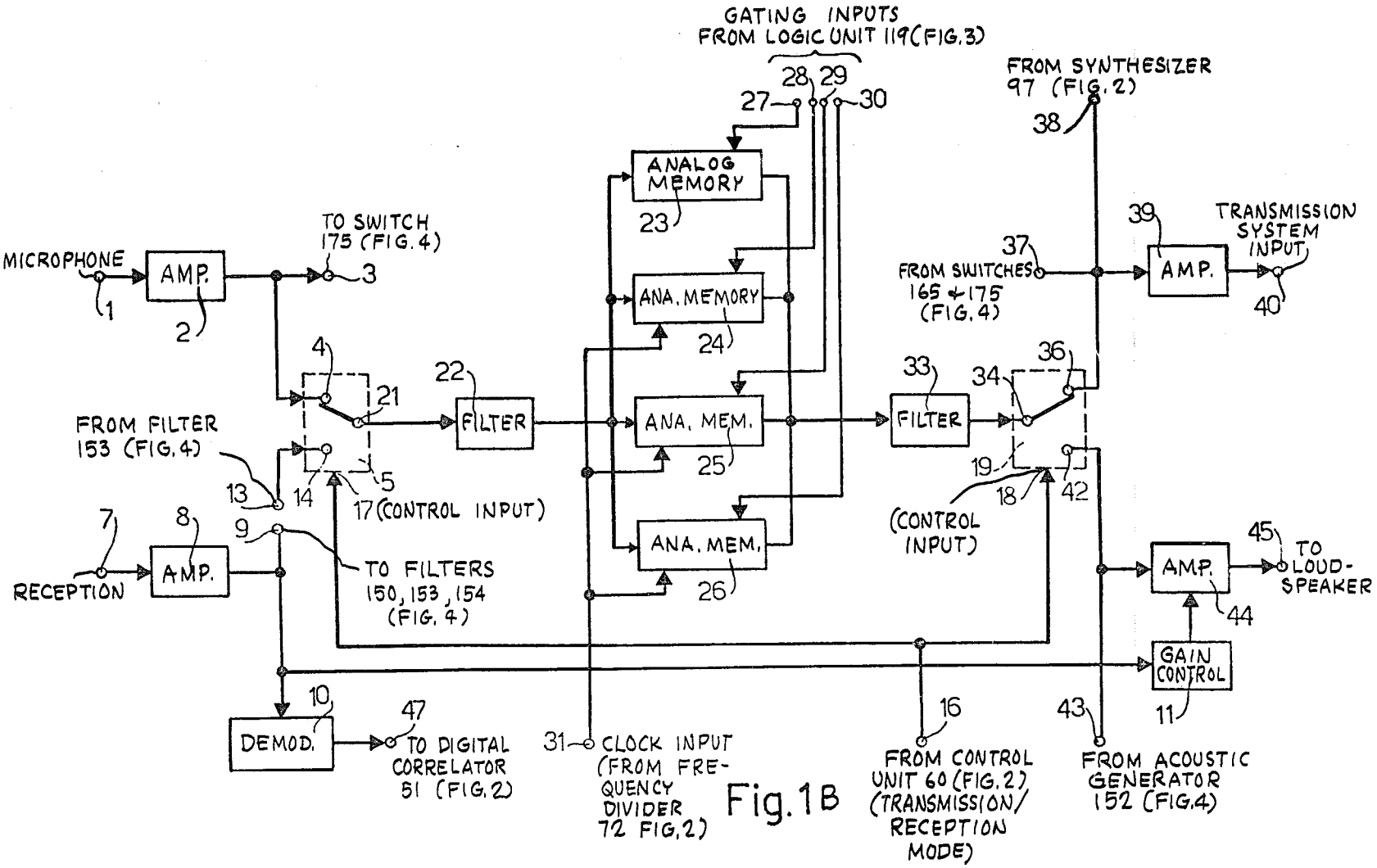
FIGS. 1B, 2 and 3 are block diagrams of different parts of another system embodying the invention.
Figure 2:
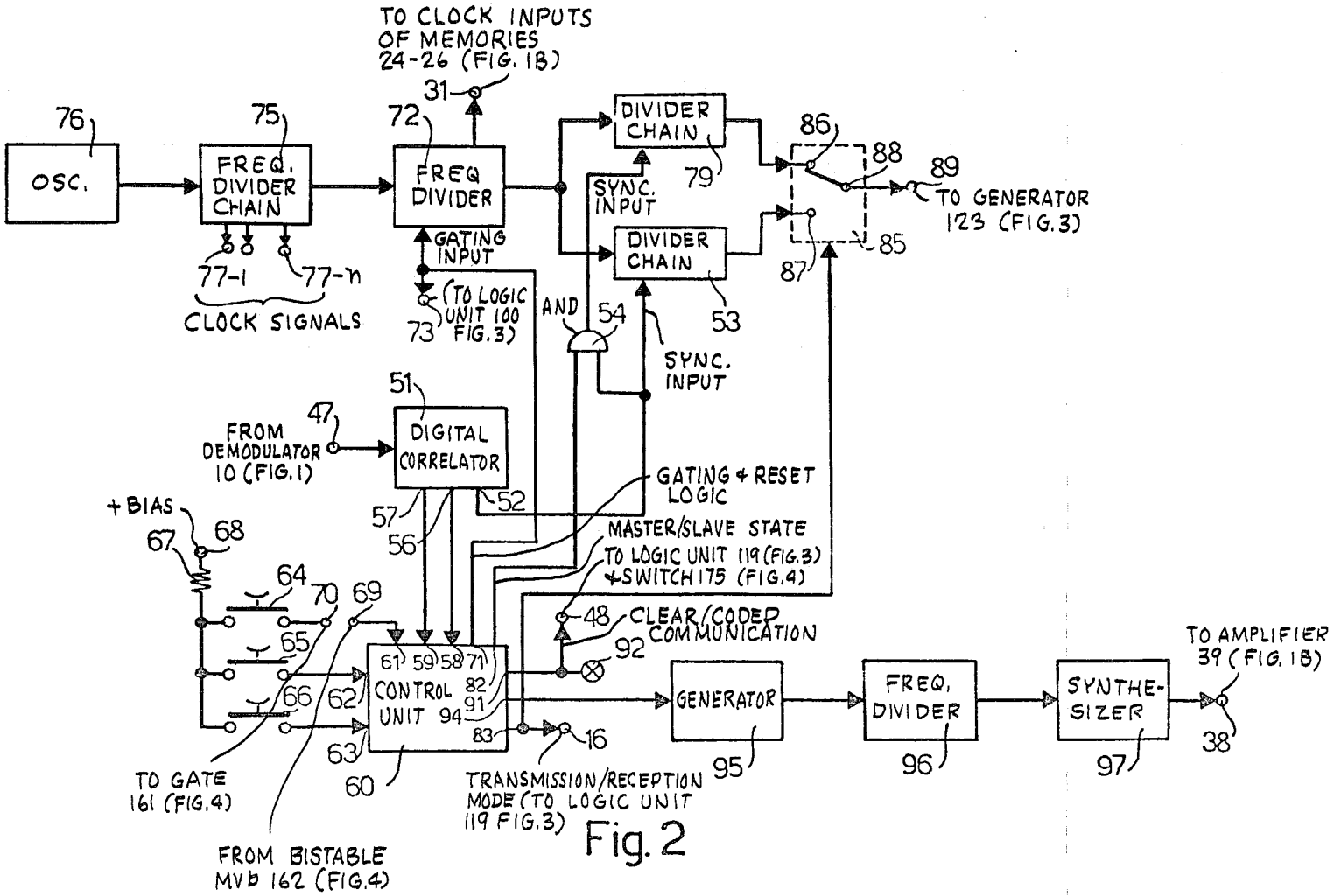

Referring now to FIG. 1B, a microphone terminates at a terminal 1 which is connected through an amplifier 2 having adjustable input impedance and gain to a terminal 3 and to a first exchange contact 4 of an electronic switch 5, formed, e.g., by a C/MOS component. The output of a reception system, e.g., a radiotelephone (not shown), terminates at a terminal 7, which is connected through an amplifier 8 to a terminal 9, to the input of a demodulator 10, e.g., of the FSK type, and to the input of a gain control unit 11. A terminal 13 (from filter 153 in FIG. 4) is connected to a second exchange contact 14 of switch 5, and a terminal 16 (from control unit 60 in FIG. 2) is connected to a control input 17 of the electronic switch 5 and to a control input 18 of an electronic switch 19. A common terminal 21 of the electronic switch 5 is connected, through a band-pass filter 22, to signal inputs of analog memories 23, 24, 25, and 26 which have gating inputs respectively connected to terminals 27, 28, 29 and 30. Further, memories 24, 25 and 26 include clock inputs connected to a terminal 31, connected to frequency divider 72 (FIG. 2). The outputs of memories 23, 24, 25 and 26 are connected together, and are thence coupled through a band-pass filter 33, to a common terminal 34 of electronic switch 19. In a preferred embodiment, memories 24, 25 and 26 are provided by an integrated circuit sold, for example, by N. V. PHILIPS' GLOEILAMPEN FABRIEKEN of Eirdhoven (Netherlands), while memory 23, which introduces no delay time between input and output, may be provided by a conventional analog switch with logic (digital) control.

A first exchange terminal 36 of switch 19 is connected to two terminals 37 and 38 respectively connected to switches 165 and 175 (FIG. 4) and to synthesizer 97 (FIG. 2), and to the input of an amplifier 39 whose output is connected to a terminal 40, which may be connected to an input of a transmission system, e.g., a radiotelephone (not illustrated). A second exchange terminal 42 of switch 19 is connected to a terminal 43 (from acoustic generator 152, FIG. 4) and to a signal input of an amplifier 44, a gating input of which is coupled to an output of the amplification or gain control unit 11. The output of amplifier 44 is connected to a terminal 45, externally connectable to a loudspeaker (not shown). Finally, the output of demodulator 10 is connected to a terminal 47 (connected to digital correlator 51, FIG. 2).

Particularly referring to FIG. 2, the terminal 47 is connected to an input of a digital correlator 51 comprising a logic circuit, recognizing a temporary pre-established sequence of logic or or digital signals at level "1" or "0". The correlator 51 has a first output 52, on which a correction logic signal is present, connected to a synchronization input of a unit 53, representing a time base for the reception system and conveniently formed by a chain of dividers (not specifically shown), and to a first input of a logic gate 54 and the AND type with two inputs. The correlator 51 has second and third outputs 56 and 57 where there are respectively present a logic signal indicating the passage to coded communication, and a logic signal indicating the passage to clear communication, connected to corresponding inputs 58 and 59 of a control unit 60 formed by means of logic elements. The unit 60 is provided with three other inputs 61, 62 and 63, respectively connected to a terminal 69 (from bistable multivibrator 162, FIG. 4) and to a first terminal of two push button switches 65 and 66. A terminal 70 (from gating unit 156, FIG. 4) is connected to a first terminal of a push button switch 64. Push button switches 64, 65 and 66 are of the normally open type, each having a second terminal all of which are connected together and through resistor 67 to a terminal 68 connected to a source of positive bias potential. Particularly, the push button switch 64 for ultimately transmitting a signal to the control unit 60, via gate 161 and bistable multivibrator 162 (FIG. 2), to request consent to send a communication, while push button switches 65 and 66 are respectively for directly sending signals to unit 60 to control the operation of the system in "clear" or "coded" communication, respectively. A first output 71 of control unit 60, where a gating and reset logic signal is present, is connected to a gating input of a frequency divider 72 and to a terminal 73 (connected to logic unit 100, FIG. 3). The frequency divider is energized through a unit 75 comprising a change of frequency dividers, in turn energized by a frequency sample signal generated by an oscillator 76, e.g., a quartz crystal oscillator. The unit 75 includes a plurality of outputs, indicated by numerals 77-1 to 77-N, at which clock signals are generated and which are further connected to various parts of the system (in a way not specifically shown but which is conventional), to enable the operation of the same in a synchronous way. Unit 72 operates as a frequency divider for the signal coming from unit 75 or according to a constant value ratio, or according to a ratio which is alternately variable between two fixed values respectively lower and higher than a constant, by the action of an external selection control (not shown). The unit 72 has a first output connected to terminal 31 (in turn connected to clock inputs of memories 24 to 26, FIG. 1B), and a second output connected to the signal inputs of units 53 and 79, representing, as the unit 53, a time base generator for the transmission system. The unit 53 is advantageously formed by a chain of dividers. A second output 82 of control unit 60, at which a logic signal is present indicating a "MASTER" or a "SLAVE" state with respect to the apparatus, at any instant, as will be later explained, is connected to a second input of logic AND gate 54, whose output is connected to a synchronization input of unit 79. A third output 83 of control unit 60, at which a logic signal is present indicating if the apparatus is in transmission or reception mode, is connected to terminal 16 (in turn connected to logic unit 119, FIG. 3), and to a control input of an electronic switch 85, preferably formed by a C/MOS component. The switch 85 has two exchange terminals 86 and 87 respectively connected to the outputs of units 79 and 53, and a common terminal 88 which is connected to terminal 89. A fourth output 91 of control unit 60, at which a logic signal is present indicating the mode of operation, i.e., "clear" or "coded" communication, is connected to a pilot lamp 92 and to a terminal 48 (connected to logic unit 119, FIG. 3). Finally, a fifth output 94 of control unit 60, at which a logic signal is present each time the apparatus must send a synchronism signal, is connected to a generator 95 for generating a pre-established time sequence of logic signals at level "1" or "0" defining control and synchronism sentences. The generator 95 is connected to turn to a frequency divider 96 for two different values and thence to a sinusoid synthesizer 97 formed, e.g., by a digital-to-analog converter whose output is connected to terminal 38 (connected to amplifier 39, FIG. 1B). The frequency divider 96 and the sinusoid synthesizer 97 essentially form together a FSK modulator.

Figure 3:
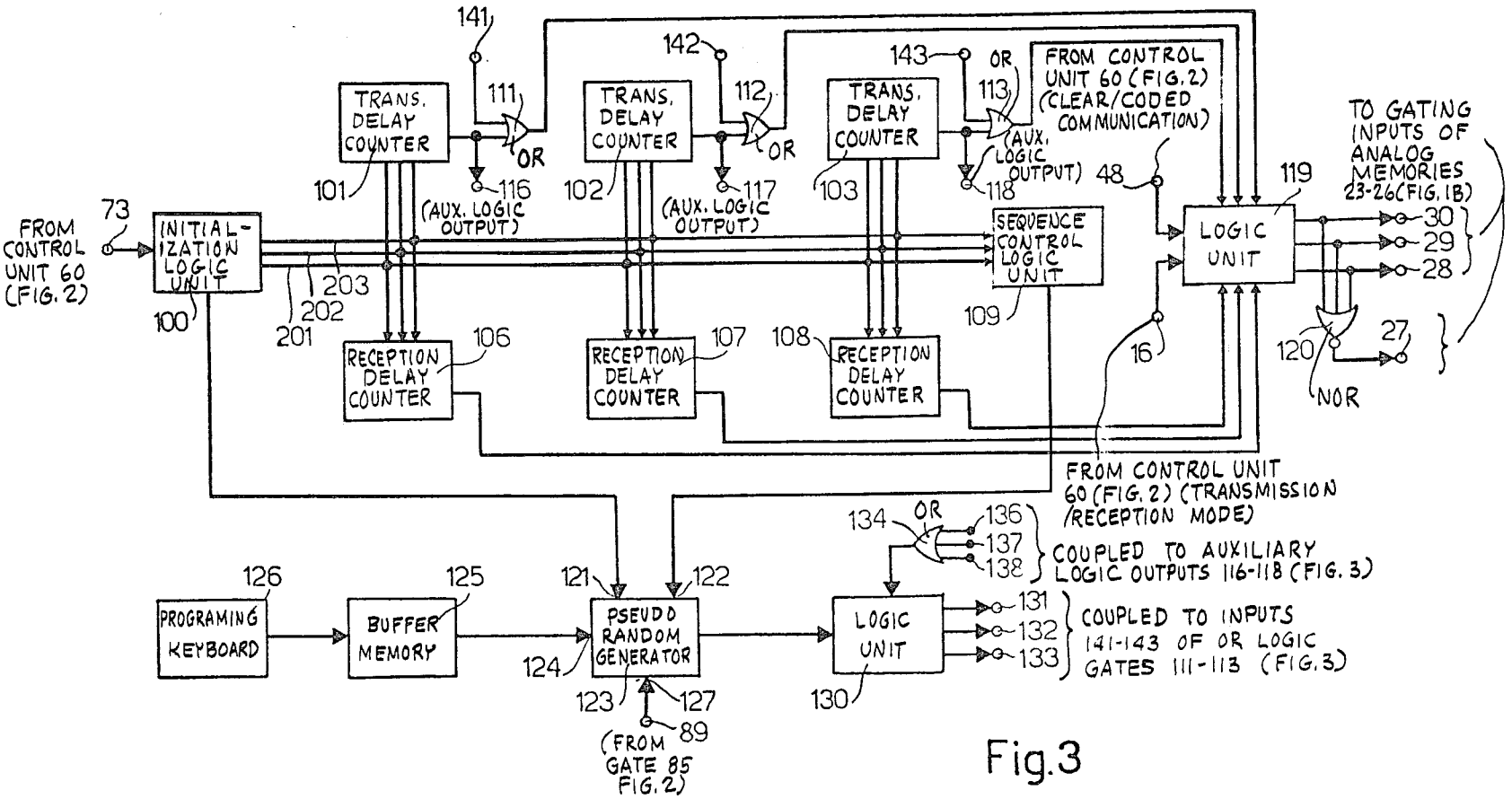

Particularly referring to FIG. 3, the terminal 73 (connected to control unit 60, FIG. 2) is connected to an input of an initialization logic unit 100, wherein a first group of three outputs is connected by three main connecting wires 201, 202 and 203 to three groups of three outputs of three transmission delay counters 101, 102 and 103, to three groups of three reset inputs of three reception delay counters 106, 107 and 108, and to three inputs of a sequence control logic unit 109. The logic unit 109 is formed, e.g., by three bistable multivibrators of the D type, whose inputs are respectively connected to the three inputs of the unit 109, and a logic network of the combiner type which effects a comparison between the input and the output signals of the bistable multivibrators and sends an output signal when it detects a coincidence situation. The counters 101, 102, 103, 106, 107 and 108 have, e.g., module 6 and are enabled to count down. Further, each transmission delay counter 101, 102 and 103 is provided with an auxiliary logic output, which assumes the logic value "1" when the number indicated by the counter is zero. These auxiliary logic outputs are each connected to an input of a corresponding two input OR logic gate, indicated as gates 111, 112 and 113, and to three corresponding connectors 116, 117 and 118. The output of each logic gate 111, 112 and 113 is connected to an input of a first group of three inputs of a logic unit 119 comprising a multiplexer. One output of each reception delay counter 106, 107 and 108, which assumes a logic level "1" when the number indicated by the counter is zero, is connected to an input of a second group of three inputs of the logic unit 119. Two auxiliary inputs of the logic unit 119 are connected to terminals 16 and 48 (from control unit 60, FIG. 2). Three outputs of logic unit 119 are connected to the three terminals 28, 29 and 30 (gating inputs of analog memories 23 to 26, FIG. 1B) and to three inputs of a logic gate 120 of the NOR type, whose output is connected to connector 27 (gating input of analog memory 23, FIG. 1B).

An auxiliary output of the logic unit 100 and an output of the sequence control logic unit 109 are respectively connected to inputs 121 and 122 of a pseudo-random generator 123, which is further energized, at an input 124, by an output signal of a buffer memory 125 connected to a programming keyboard 126. The generator 123 includes a further input 127 which receives a signal from terminal 89 (from gate 85, FIG. 2). An output of the pseudo-random generator 123, where the numbers 0, 1, 2 and 3 are present in binary form in a pseudo-random sequence, is connected to a first input of a logic unit 130 for the processing of the numbers 0, 1, 2 and 3. The unit 130 is also an initialization logic network, and has three outputs connected to terminals 131, 132 and 133, and a second input from logic OR gate 134. This latter gate has three inputs connected to terminals 136, 137 and 138 which in turn are respectively connected to the three terminals 116, 117 and 118 (the auxiliary logic outputs of counters 101, 102 and 103, FIG. 3); the connection between terminals are not shown in FIG. 3. Finally, the terminals 131, 132 and 133 are respectively connected to terminals 141, 142 and 143 (in a way not shown in FIG. 3) which are respectively connected to a second input of the OR logic gates 111, 112 and 113.

Figure 4:
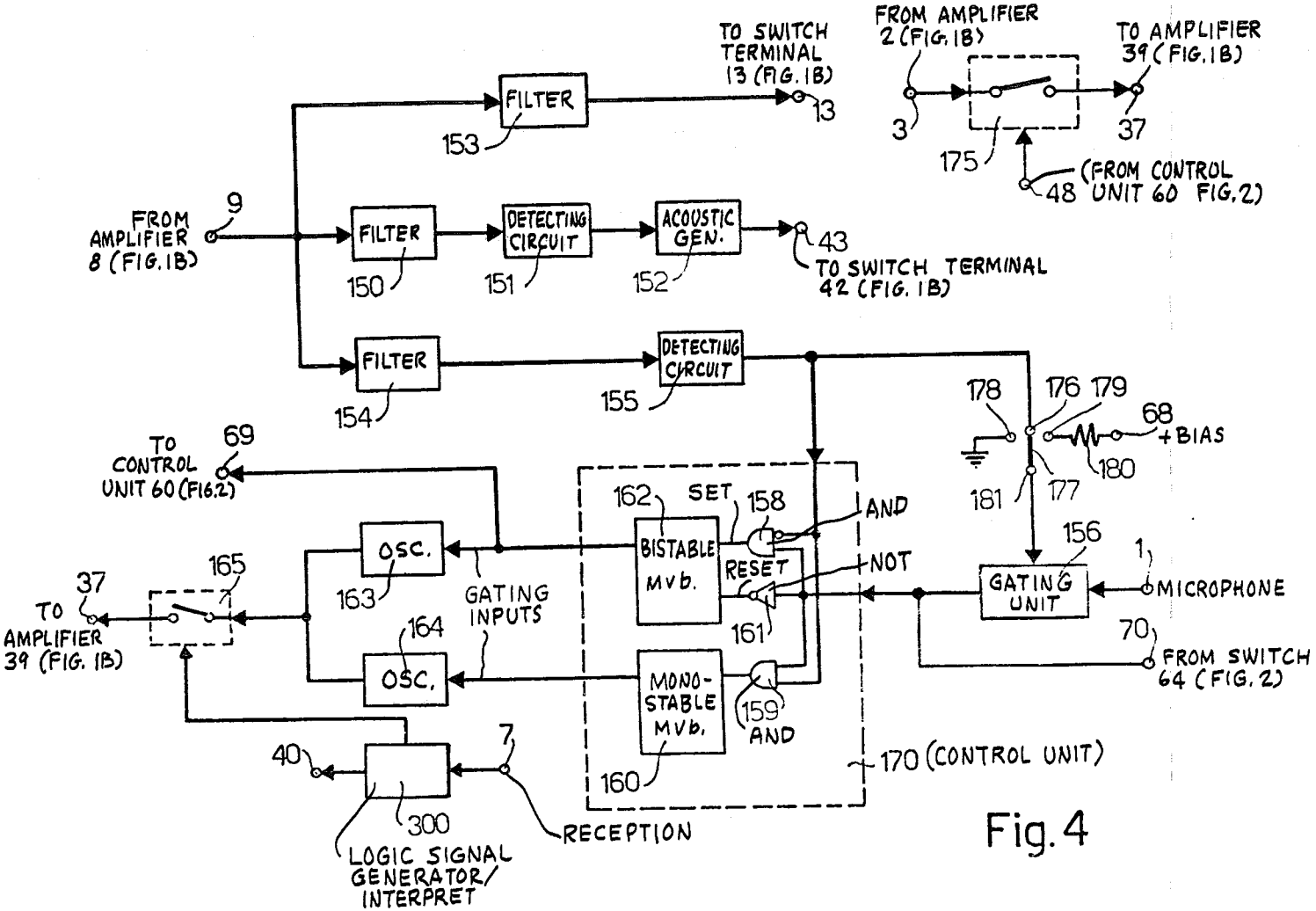
FIG. 4 is a block diagram of a circuit operable with the circuits of FIGS. 1B, 2 and 3 to make automatic some operations therein to improve the operation of the circuits.

With particular reference to FIG. 4, the terminal 9 (from amplifier 8, FIG. 1B) is connected to terminal 43 (in turn connected to switch terminal 42, FIG. 1B) through a series circuit constituted of a filter 150, which allows the passage of a single frequency, e.g., 1000 Hz, a detecting circuit 151 and an acoustic generator 152. The terminal 9 is further connected, through a filter 153 that suppresses a fixed frequency, e.g., 1600 Hz, to terminal 13 (coupled to switch 4, FIG. 1B), and through a filter 152 allowing the passage of a single frequency, e.g., 1600 Hz, to the input of a detecting circuit 155. The output of detecting circuit 155 is connected to a first exchange terminal 176 of a three position commutator 177, to a denied input of a logic gate 158 of the AND type, and to a first input of a logic gate 159 of the AND type. The output of gate 159 is connected to the input of a monostable multivibrator 160. The commutator 177 is further provided with a second exchange terminal 178 which is grounded and with a third exchange terminal 179 connected through a resistor 180 to terminal 68 (connected to a positive bias potential). The commutator 177 also includes a common terminal 181 connected to a gating unit 156.

The unit 156 has its input connected to terminal 1 (microphone), and its output, at logic level "1" or "0" according to the presence or absence of an electrical signal at the input, is connected to terminal 70 (from switch 64, FIG. 2). The output of gating unit 156 is connected to a non-denied input of logic AND gate 158, to the input of a logic NOT gate 161 and to a second input of the AND gate 159. The output of AND gate 158 and the output of NOT gate 161 are respectively connected to SET and RESET inputs of a bistable multivibrator 162 of the SET-RESET type, whose output is directly connected to terminal 69 (control unit 60, FIG. 2), and further connected to a gating input of an oscillator 163 having a fixed oscillation frequency, e.g., 1600 Hz. An output of the monostable multivibrator 160 is connected to a gating input of an oscillator 164 having a fixed oscillation frequency, e.g. 1000 Hz. whose output, together with the output of oscillator 163, is connected to terminal 37 (amplifier 39, FIG. 1B) through an electronic switch 165, preferably formed by a C/MOS component. A gating input of the electronic switch 165 is connected to an auxiliary output of a unit 300 which has its input connected to terminal 7 (reception) and its output connected to terminal 40 (transmission system input). The unit 300 comprises circuits of a known type, suitable to generate and interpret a sequence of more logic signals.

The monostable multivibrator 160 and the bistable multivibrator 162, together with the logic AND gates 158 and 159 and NOT gate 161, are parts of a single control unit 170. Finally, the terminal 3 (amplifier 2, FIG. 1B) is connected to terminal 37 (amplifier 39, FIG. 1B) through an electronic switch 175, advantageously formed by a C/MOS component, which has a gating input connected to terminal 48.

The operation of the above-described apparatus will now be examined in its two possible communication modes, "clear" and "coded". Referring first to FIGS. 1B to 3, and then next to FIGS. 1B to 4, an automatic analysis is made by the system of the communication line type (simplex or duplex) connecting the system with another system with which communication is established, and it is ascertained whether or not the other system is provided with analogous automatic features.

Referring to FIGS. 1B to 3, and assuming that two users are connected one to another with two systems in use, one in transmission and the other in reception. In such case terminals 9, 13 (FIG. 1B) and 69, 70 (FIG. 2) are "shorted", and, in addition to the terminals previously indicated in the specification, the terminals that are indicated by the same reference numeral are also connected to each other.

Assuming further that the connection begins with a "clear" communication, both users having actuated the push button switch 65 (FIG. 2) and the transmitting user keeping depressed the push button switch 64 (FIG. 2). In such conditions, outputs 71, 82, 91 and 94 of the control logic units 60 (FIG. 2) of the respective systems are at the "0" logic level, while output 83 is at "1" level for the transmitter and at "0" level for the receiver. The output 83 determines, for the transmitter, the respective connections between terminals 86 and 88 of switch 85 (FIG. 2), terminals 4 and 21 of switch 5 (FIG. 1B) and connectors 34 and 36 of switch 19 (FIG. 1B). For the receiver, the respective connections between connectors 87 and 88, 14 and 21, 34 and 42 of corresponding switches 85, 5 and 19 are determined by output 83. Further, the output 91 retains extinguished the signaling lamp 92 (FIG. 2) and, through the connection to terminal 48, results in a signal level "0" being produced at the three outputs of the logic unit 119 (FIG. 3) determining consequently a level "1" at terminal 27 (FIG. 3) in both systems. In this fashion, memory 23 is enabled but, in this particular case, it does not introduce any delay between the inputs and the outputs of the systems.

Thus, with reference to FIG. 1B, the phonic signal from the microphone of the transmitting user connected to terminal 1 is transmitted to the reception system of the receiving user through the following components of the transmitting system: amplifier 2, terminals 4 and 21 of switch 5, filter 22, memory 23, filter 33, terminals 34 and 36 of switch 19, amplifier 39 and terminal 40 connected to the radiotelephone, e.g. From the reception system of the user, the signal is transmitted through the receiving system as follows: from terminal 7 through amplifier 8, terminals 9 and 13, terminals 14 and 21 of switch 5, filter 22, memory 23, filter 33, terminals 34 and 42 of switch 19, amplifier 44, and terminal 45 to switch the loudspeaker, e.g., is connected. Finally, the gain control unit 11, by reducing the gain of amplifier 44 when the output signal of amplifier 8 is not present, permits a reduction of background noise in the loudspeakers of both transmitting and receiving systems.

An inversion of the communication direction between the two users is possible when the transmitting user releases his push button switch 64 and the receiving user depresses the corresponding push button 64 (FIG. 2). In the two systems, only the signal at output 83 changes and assumes a logic level opposed to the preceding state, enabling switches 5, 19 and 85 (FIGS. 1B and 2) to assume positions complementary to the preceding positions.

The transition from "clear" to "coded" communication by a transmitting user and one or more receiving users occurs consequently to the actuation of push button switch 66 by the transmitting user. That actuation makes the transmitting apparatus a "MASTER" station, wherein the time base generator 79 (FIG. 2) cannot be synchronized and becomes a reference time base generator. All the other receiving systems connected with the transmitting system become "SLAVE" stations, wherein the time base generators 53 and 79 (FIG. 2) will be synchronized at each transmission of a synchronism signal.

In particular, in the control unit 60 of the MASTER system (FIG. 2), in addition to output 83 already at level "1", outputs 71, 91 and 94 are brought to level "1" and output 82 is retained at level "0". The output 94 enables operation of generator 95, which, through the frequency divider 96, synthesizer 97, (all FIG. 2), amplifier 39 (FIG. 1B) and the radiotelephone, e.g., connected thereto, sends a signal of the transition to "code" and of modulation synchronism in FSK to the various receiving users. The output 82 at level "0" prevents the sending of any synchronism signal to the transmission time base generator 79 of the MASTER system, and the output 91 at level "1" enables the pilot lamp 92, indicating an operation in "code" mode. The output 91, acting through connector 48 disengages the outputs of logic unit 119 (FIG. 3) wherein the inputs from OR gates 111, 112, 113 are respectively coupled to terminals 28, 29 and 30 due to the control signal from terminal 16 from control unit 60 (FIG. 2). Finally, the passage at level "1" of output 71 of the control unit 60 enables divider 72, which sends sampling clock pulses via terminal 31 to memories 24, 25 and 26 (FIG. 1B) and clock pulses via transmission time base generator 79, terminals 86 and 88 of switch 85 and terminal 89 to pseudo-random generator 123 (FIG. 3).

Further, the output 71 of control unit 60 transmits via terminal 73 a gating control signal to the initialization logic unit 100 (FIG. 3), which in turn transmits to input 121 of the pseudo-random generator 123 a control signal allowing the presetting of that generator with the data contained in the buffer memory 125 previously stored by the external control of the programming keyboard 126.

In this first period the generator 123, after having been preset, is advanced a considerable number of clock steps at a very high rate, e.g., 1000, through a control signal from logic unit 100 allowing the connection of the input 127 of generator 123 to one of the output terminals 77-1 to 77-N of unit 75 (FIG. 2) where a clock signal is present at a very high frequency. At the end of this advancing, and for a time lapse corresponding to three steps of the time base generator 79 (FIG. 2), an inner circuit of logic unit 130 (FIG. 3) is enabled and establishes at level "1" for a single clock step each one (and in three consecutive steps) of the three outputs of unit 130 respectively connected to terminals 131, 132 and 133. These "1" levels are respectively transferred in order to terminals 28, 29 and 30 through the logic gates 111, 112 and 113 and the inner connections of logic unit 119. Thus the memories 24, 25 and 26 (FIG. 1B) are enabled in order to receive the first three phonic signal fragments sampling frequency determined by the clock signal from terminal 31 connected to divider 72 (FIG. 2). Further, during these three consecutive clock steps, and by means of a network (not shown), the logic unit 100 (FIG. 3) provides for the respective presetting at 6 and at 3 of counters 101 and 106 during the first clock step, counters 102 and 107 during the second clock step, and counters 103 and 108 during the third clock step. At these counters countdown, during the third clock step, the numbers contained in the counters 101, 102 and 103 will respectively be 4, 5 and 6, and the numbers contained in the counters 106, 107 and 108 will respectively be 1, 2 and 3.

Consider, in this first phase, the behavior of the receiving system connected to the MASTER transmitting system. In each system (FIG. 1B), the reception of the synchronism signals and the passage to coding signals, through the reception system connected to terminal 7, amplifier 8, FSK type demodulator 10 and correlator 51 (FIG. 2), causes the transmission of a passage to coding signal from output 56 of the digital correlator 51 to the input 58 of the logic unit 60 and the transmission of the synchronism signal from output 52 to the synchronization input of the time base generator 53 as well as to the input of AND gate 54. Instantaneously, the unit 60 drives to level "1" the outputs 71, 82 and 91. The output 82 permits the synchronism signal from the MASTER apparatus (and present at the output 52 of unit 51) to act also at the synchronization input of the transmission time base generator 79 of the SLAVE apparatus. Outputs 71 and 91 originate in the SLAVE apparatus a group of operations quite analogous to those described for the MASTER apparatus. In this case, output 94 remains at level "0" and does not enable the control sentence generator 95. Output 83, already at level "1" before the arrival of the synchronism signals and passage to coding signals, in addition to the positioning switches 5 and 19 (FIG. 1B) and 85 (FIG. 2), as already described for the operation of the apparatus receiving in "clear" mode, also provides the connection of reception delay counters 106, 107 and 108 (FIG. 3), respectively with connectors 28, 29 and 30.

In this instant the synchronization phase terminates and a true coded communication phase between the various systems begins, wherein the pseudo-random generators 123 (FIG. 3), the transmission delay counters 101, 102 and 103, the reception delay counters 106, 107 and 108 and the logic units 109 and 130 of the transmitting apparatus and the receiving apparatus follow in a synchronous way the same sequence of logic states, and the description of their operation is valid for all the systems having received the synchronism signal.

With particular reference to FIG. 3, at each clock signal step coming from connector 89 connected to the time base generator 53 or 79 (FIG. 2), the pseudo-random generator 123 provides at its output a pair of binary numbers, as 00, 01, 10 and 11 which is transferred to the first input of logic unit 130. The transmission of one of the logic signal pairs 01, 10 or 11 to the logic block 130 determines a signal at level "1" respectively transmitted to terminals 131, 132 or 133. Each of the signals at level "1" is sent to the corresponding logic OR gate 111, 112 or 113, whose output, connected to the MASTER apparatus at the gating inputs of memories 24, 25 or 26 (FIG. 1B) through the logic unit 119 (FIG. 3), determines the use of one of the memories, with the consequent transmission in line of the phonic signal fragment contained in that memory and the storing of a new phonic signal fragment generated by the transmitting user. Further, during a first phase included within a clock signal step at terminal 89, the signal at level "1", according to a network (not shown), enables the transfer of the binary number contained in the corresponding transmission delay counter 101, 102 or 103 to the connecting wires 201, 202 and 203. In a second phase, always included within the clock signal, the positioning of the transmission delay counter is arrested at 6. In the meantime, that one of the reception delay counters 106, 107 and 108, which in its countdown within the clock step has reached the value "0", transmits a signal at level "1" to its output. This output in the SLAVE apparatus is connected through the logic unit 119 to the gating input of memory 24, 25 or 26 (FIG. 1B), and determines thereby the use of the memory connected thereto. Use of the memory results in the consequent transmission of the contents of the same to the loudspeaker of the receiving user and the storing of the phonic signal fragment transmitted in that instant in line by the MASTER apparatus. Furthermore, correspondingly with this first phase, the output signal of contour 106, 107 or 108 at level "1" enables that counter to be preset with the number which has been transferred from one of the counters 101, 102 and 103 to the connecting wires 201, 202 and 203. When the number 00 reaches the logic unit 130 from generator 123, the outputs of the unit 130 connected to terminals 131, 132 and 133 are kept at level "0", and consequently the memory 23 (FIG. 1B) of the transmitting apparatus is gated through the logic NOR gate 120 (FIG. 3) and terminal 27 and sends directly to terminal 40 (FIG. 1B) the phonic signal fragment emitted in that instant by the transmitting user. Further, none of the transmission delay counters is enabled to transfer its contents to conductors 201, 202 and 203. Thus in this particular case the reception delay counter whose contents goes to "0" is preset at 6 by means of a network (not shown), and the memory of the receiving system which accepts the phonic signal fragment sent by the transmitting system will be therefore recalled in operation after 6 clock steps corresponding to 6 fragments.

In conclusion, each phonic signal fragment transmitted by the transmitting system, with a delay varying from 0 to 5 clock steps, is further delayed in the receiving system by a number of clock stages corresponding to the complement to 6 of the delay received in the transmitting system. In effect, the contents of each memory in the receiving system is enabled to be transferred to the loudspeaker by its reception delay counter, which completes the countdown initiated by the transmission delay counter preset at 6 on storing the phonic signal fragment by the memory of the transmitting system.

The described operation of the pseudo-random generator 123 is subject to two limitations. The first is due to the fact that a phonic signal fragment must have a total delay in the transmitting and receiving apparatus not greater than 6 clock steps, and the second, due to the fact that in order to obtain a good coding of the phonic signal, it is advantageous that fragments of the signal which are stored consecutively in the memories of the transmitting apparatus are not transmitted consecutively by the same.

In the first of the two above-mentioned cases, when one of the transmission delay counters 101, 102 or 103 of the transmitting apparatus during its countdown reaches the "0" value, corresponding to the remaining of the phonic signal fragment in the memory associated thereto for 6 clock steps, the counter generates at its output a signal at level "1". This signal reaches, through the logic OR gate 134, the second input of the logic unit 130, and causes the three outputs 131, 132 and 133 of the unit to be at the "0" level during one clock step. Furthermore, in the transmitting system, through the OR logic gate 111, 112 or 113, to which each output of counters 101, 102 and 103 is respectively connected, the corresponding memory is enabled. In the receiving system, no reception delay counter reaches the "0" value during such clock step, whereby the three outputs of unit 119 remain at level "0", and memory 23 (FIG. 1B) is thereby enabled through the logic NOR gate 120. Thus memory 23 introduces no delay and directly sends the signal fragment from the transmitting apparatus to the loudspeaker of the receiving apparatus.

Concerning the second of the two cases, it has been observed that if two signal fragments, consecutively stored, are still transmitted consecutively, the numbers transferred by the transmission delay counters, present in two subsequent clock steps in the connecting wires 201, 202 and 203, are equal. The sequence controlling logic unit 109 effects a comparison for each consecutive pair of numbers present on wires 201, 202 and 203. If a coincidence results between any pair, it sends to the input 122 of generator 123 a signal which causes that generator to move rapidly forward one step, and the generator emits a new pair of binary numbers. If the new pair of numbers emitted by generator 123 is different from the preceding pair, the operation begins again as described. In the opposite case, the logic unit 109 causes the emission of another pair of numbers by the generator 123 until a maximum of four consecutive steps. The intervention of the control unit 109 does not produce however the desired effect if the pseudo-random generator 123 emits the same pair of numbers four times consecutively (a considerably improbable event) or if the delay accumulated by the fragment in the memory of the main system is already the maximum allowed. As long as an inversion of the communication direction does not intervene, the operation of the apparatus proceeds as described. However, since it is necessary to maintain the time base generators 53 and 79 (FIG. 2) of the different systems perfectly synchronized, and the quartz crystals of oscillators 76 are typically not sufficiently stable, the MASTER apparatus sends at regular intervals, e.g., each minute, a set of synchronizing pulses through generator 95, divider 96, synchronizer 97 (all FIG. 2), amplifier 39 (FIG. 1B) and the radiotelephone connected thereto to the various SLAVE systems which are receiving signals at that time.

These latter synchronizing pulses, demodulated by demodulator 10 (FIG. 1B), are interpreted by the correlator 51 (FIG. 2) of the SLAVE system, which provides through output 52 the synchronization of time base generators 53 and 79.

The non-reception of one or more sets of synchronizing pulses does not cuase the interruption of the communication between the various systems, but it causes only a slight non-correlation between the time bases of the MASTER and SLAVE systems, which is then corrected by the reception of the subsequent set of synchronizing pulses.

The inversion of the communication direction, resulting from the release by the transmitting user of his push button switch 64 (FIG. 2) and the actuation, by one of the receiving users his push button switch 64, determines the transmission, by the apparatus which was previously receiving, of a synchronism signal. That signal aligns all the time base generators 53 and 79 of the SLAVE systems (each receiving time base generator 53 is connected to its transmission time base generator 79), and only the receiving time base generator 53 of the MASTER system. The transmitting time base generator 79 of the MASTER system remains as the reference time base generator, because the output of unit 60 of the MASTER system is retained at level "0" and prevents the passage of the receiving synchronism signal towards its time base generator 79. A further passage to transmission of the MASTER system user determines the sending of a new synchronism signal to the other systems and restores the situation described before the inversion of the communication direction.

It is possible for the transmitting user (which may be the MASTER or the SLAVE system) to depress at any time push button switch 65 (FIG. 2), which causes directly in the same system and indirectly in the receiving systems connected thereto the passage or transition to "clear" communication mode through a set of synchronism and passage to clear pulses, sent through generator 95. These pulses determine a signal at output 57 of the various correlators 51, which signal reaches the logic unit 60 and causes the restoring of the "clear" mode of operation in the various systems, as described above.

The system described also permits a frequency coding of the phonic signal fragments transmitted. In effect, it is possible to act on unit 72 (FIG. 2) through external control and send alternately two different sampling clock frequencies to memories 24, 25 and 26 (FIG. 1B). Correspondingly, a clock signal is further sent to the pseudo-random generator 123 (FIG. 3) through the time base generator 79 of the transmitting apparatus and the time base generator 53 of the receiving apparatus. This clock signal has a duration inversely proportional to the above two sampling frequencies, so as to always to obtain the same number of phonic signal samples within each memory. As the connected systems act in a synchronous way, the phonic signal fragments are stored by the transmitting system and transmitted to the loudspeaker of the receiving system at the same sampling frequency, while the transmission in line of the fragment by the transmitting system, being controlled by the pseudo-random generator 123, may occur at a clock frequency different from the sampling frequency.

The practical result is the obtaining, with a simple variation of the sampling frequency by the divider 72, a compression or an expansion in the time of the signal transmitted and therefore a corresponding expansion or compression of the same signal band, according to a pseudo-random rhythm.

With reference to FIGS. 1B to 4, the operation of the apparatus with an additional circuit partially illustrated in FIG. 4 will be examined. The circuit of FIG. 4 improves performance by permitting operation in duplex or simplex, with the possibility of the receiving user advising the transmitting user that he desires to intervene, when the communication line is duplex and the two systems connected are both provided with circuitry as in FIG. 4.

Assume, in the first instance, that all the terminals in FIG. 4 are connected to the same numbered terminals shown in FIGS. 1B to 3, and that terminals 179 and 181 of commutator 177 are connected together. A logic signal at level "1" is sent through the commutator to the gating input of unit 156, causing that unit to be disabled.

The system first asking for the transition or passage to "coded" mode becomes the MASTER system and initiates a known proceeding, e.g., in the computer field, with the second system by transmitting to the latter, through unit 300 a first coded signal suitable to verify if the line is duplex and if the second system is provided with automatic features similar to the first system. If both these conditions do not occur, the communication established between the two users may only be simplex and occurs as previously described. If instead, the communication line is duplex and the second system is provided with the automatic features, the latter system answers, through its unit 300, with a second coded signal, whose reception by unit 300 of the first system confirms to the latter the possibility of communicating in duplex. The unit 300 of the first system sends first a consent signal for the closure of the analog switch 165, and sends further to the corresponding unit 300 of the second system a third coded signal analogous to said second signal, by means of which it confirms the same connection possibility to the second system, allowing thereby the closure of the relative analog switch 165 in the second system.

At this time, having executed this procedure, the communication between the two users may begin and, in addition to the voice signal still coded as previously described, a signal at 1600 Hz, e.g., is also sent to the receiving user. This signal is generated by oscillator 163, enabled in turn by the actuation of push button switch 64 (FIG. 2) and the consequent energizing at level "1" the bistable multivibrator 162 (FIG. 4). The signal at 1600 Hz is not hard by the receiving user, since it is filtered out by filter 153, but it passes through filter 154 and is detected by detector 155. Detector 155 emits at its output a signal at level "1" which prevents the enabling of the bistable multivibrator 162, and therefore prevents in the receiving system the activation of input 61 of logic unit 60 (FIG. 2) and the sending of a corresponding signal at 1600 Hz to the transmitter. When the receiving user desires to intervene and speak, he advises the transmitting user by actuating push button switch 64 (FIG. 2). This actuation enables the monostable multivibrator 160 (FIG. 4; the bistable multivibrator 162 is locked) which determines the sending in line of a short signal at 1000 Hz, e.g., through oscillator 164. This signal passes in the transmitting apparatus through filter 150, detector 151 and the acoustic generator 152, which emits a warning signal to the user's loudspeaker through the terminal 43, amplifier 44 and the connector 45 (FIG. 1B). The transmitting user, hearing this warning, may give the line to the receiving user simply by releasing his push button switch 64 (FIG. 2). The bistable multivibrator 162 (FIG. 2) of the transmitting apparatus is thereby deactiviated and the control signal at input 61 of logic unit 60 (FIG. 2) is then lacking. There is also lacking the signal at 1600 Hz produced by oscillator 163 (FIG. 4) and the signal at the output of detector 155 in the receiving system. The receiving user may therefore activate, by depressing his push button switch 64, his own multivibrator 162 and likewise control unit 60 through input 61, as well as activation of oscillator 163. A further passage in "clear" allows the conversion between the two users to occur in duplex, as the transmission of the phonic signal is effected through amplifiers 2 and 39 (FIG. 1B), the analog switch 175 (FIG. 4) being closed to connect these two amplifiers by the control signal from terminal 48 (control unit 60, FIG. 2). The reception occurs through amplifier 8 and filter 153 (FIG. 4), connectors 14 and 21 of switch 5, filter 22, memory 23, filter 33, contacts 34 and 42 of switch 19, amplifier 44 and the loudspeaker connected (all the latter of FIG. 1B).

An improvement in performance may be obtained by actuating manually the commutator 177 so as to connect the terminals 176 and 181 and thus using the gating unit 156 partially in place of push button switch 64. The unit 156, in the presence of the phonic signal at terminal 1 from the transmitting user, sends a a signal at level "1" to the control unit 170, thereby eliminating the need for the user to retain the push button switch 64 actuated and rendering the conversation more like a conventional duplex telephone conversation. When the users system is in the reception mode, the unit 156 is disabled by the signal at level "1" from detector 155, and the eventual interruption request must still be made through use of push button switch 64.

Finally, the actuation of commutator 177 connecting together terminals 178 and 181 produces a signal at level "0" at the gating input of unit 156, permanently enabling that unit. Consequently, the unit 156 permits the sending of an interruption request by the receiving user through a simple vocal request, thus avoiding completely the actuation of push button switch 64.

From the description above, it is apparent that the invention solves in a reliable way the coding of a phonic signal in the time domain and further provides greater security by coding the signal in the frequency domain through unit 72 (FIG. 2). In particular, the utilization of memories 23, 24, 25 and 26 (FIG. 1B) allows a considerable simplification of circuitry and a consequent reduction of cost relative to systems utilizing digital memories coupled to analog-to-digital and digital-to-analog converters. In this regard, the system of FIG. 1B is an improvement over that of FIG. 1A. The adjustment of input impedance and gain of amplifier 2 adapts the apparatus to any type of microphone. A considerable improvement has been further obtained in the mixing of the transmitted fragments of the phonic signal, with a corresponding increase of communication security through control of the Number of pairs provided by generator 123 (FIG. 3) through the sequence control unit 109 which prevents the transmission of the phonic signal fragments in their natural order.

The setting of the contents of buffer memory 125 (FIG. 3) occurs in such a way that the memory retains its contents even if the system is switched off, but the contents are automatically blanked in case of a violation of the system to prevent the discovery of the same. Such a setting may be made through use of the keyboard 126, but also by sealed selectors, punched or magnetic cards or other methods. It is further possible to provide the apparatus with an additional memory suitable for storing a plurality of different contents, corresponding each one to a particular positioning of the initial sequence provided by generator 123, and therefore, to a particular user.

The particular synchronism system adopted, compared with known systems, does not require the transmission of a continuous correction signal, and permits a concentration of the whole power supplied to the apparatus in the phonic signal. It further prevents an apparatus already synchronized from losing the connection even if it does not receive the synchronism signals for a certain time period (even some minutes). Further, in a transmission network with several systems interconnected, the possibility of one of the systems telecontrolling the passage from "clear" communication to the "coded" of all the others simplifies remarkably the operations which formerly were effected manually by the various users. At the same time, it is possible to obtain, with suitable variants, a complete telecontrol at a distance of all the functions carried out by the interconnected users. A further feature of the invention is the coding through "modem" of teletypewriter or Morse signals. Finally, the automatic individualization of the communication line type and the type of apparatus connected permits an operation very similar to that of a normal telephone.

It will be obviously understood that modifications and variations may be made to the apparatus described. For example, it is possible to replace the analog memories 23, 24, 25 and 26 (FIG. 1B) with memories of the digital type associated with analog-to-digital and digital-to-analog converters, respectively located upstream and downstream of the memories as in the system of FIG. 1A. Further, the control unit 60 may be modified so that, during "coded" communication, to the transmitting apparatus and at each connection inversion, in addition to the correction signal of the time base generators 53 and 70 (FIG. 2), the signal for transition to "coded" mode is also sent, which is suitable to preset each time the pseudo-random generator 123 of the receiving systems with the data contained within the relative buffer memories 125. This expedient is particularly useful for "coded" communications considerably delayed from one another in time (even by some hours), for which a simple correction operation of the time base generators 53 and 79 would be insufficient, and it would instead be necessary to actuate manually, each time, the control circuitry for the transition to the "coded" communication.

The invention thus should be taken as defined by the following claims. In interpreting the claims, it should be noted that reference numerals have been employed, relating some of the features of the claims to the drawings herein. This has been done for the purpose of aiding in understanding the invention, is by way of example only, and in no way is intended to limit the claims to the specific features shown in the drawings or described in the specification.

What is claimed is:

1. Apparatus for the coding and decoding of electrical signals within a pre-established frequency band and useful for providing communication secrecy, which may be connected between means for the generation and reception of said electrical signals and means for the exchange of said coded signals with at least one other coding and decoding apparatus, comprising a transmission and coding circuit and a reception and decoding circuit for said signals, commutation means for complementarily enabling said transmission and coding circuit and said reception and decoding circuit, said circuits comprising first means for temporarily storing consecutively received portions of said electrical signals, and second means for enabling the operation of said first means to consecutively store in memory said signal portions and to transmit said signal portions, in a different order, to one of said exchange means and said means for the reception of said signals, in which said first means includes a plurality of memory elements (22'–25', 23–26) in which said second means comprises means (123) for generating logic signal whose states correspond each to one of the memory elements (23–26) of said first means and which evolve according to an established sequence, a first group of counter circuits (101, 102, 103) each one associated with one of said memory elements, processing circuit means (130) in said coding and decoding circuits and responsive to signals from said logic signal generating means (123) for enabling said counter circuits to transmit numerical information contained in said counter circuits to a first group of connections (201, 202, 203) and thereafter to establish the numerical information in said counter circuits at a pre-established value.

2. Apparatus according to claim 1 in which said logic signal generating means (123) controls said processing circuit means (130) to enable, in said coding circuits, the operation of said memory elements associated with said counter circuits, said processing circuit means receiving at a second input thereof a signal from an output of each counter circuit and generating output signals which establish particular values of numerical information in said counter circuits notwithstanding the state of said logic signal generating means.

3. Apparatus according to claim 1, including a second group of counter circuits (106, 107, 108) and a sequence control circuit (109) all of which receive positioning input signals from said first group of connections (201, 202, 203), said control circuit (109) determining a forced advancing of one step of the sequence of said logic signal generating means (123) correspondingly with coincident values of said numerical information transmitted in two consecutive instants corresponding to the consecutive enabling of two of said memory elements.

4. Apparatus according to claim 3, in which each of said second group of counter circuits (106, 107, 108) includes an output for enabling in said reception circuit the operation of said memory element associated therewith.

5. Apparatus according to claim 1, including memory means (125) coupled to said logic signal generating means (123) for controlling an initial state of the sequence established by said logic signal generating means.

6. Apparatus according to claim 5, in which said memory means (125) is controlled by a programming keyboard means.

7. Apparatus according to claim 5, including a positioning control circuit (100) for advancing the sequence of said logic signal generating means (123) a finite number of steps from its first initial state to a second initial state, and to allow afterward, in a plurality of steps immediately consecutive to said second initial state, a positioning at a pre-established initial value of said first and second groups of counter circuits.

8. Apparatus according to claim 5, in which said memory means is controlled by punched card means.

9. Apparatus according to claim 5, in which said memory means is controlled by magnetic card means.

10. Apparatus according to claim 5, in which said memory means is controlled by sealed selector means.

11. Apparatus according to claim 1, in which said transmission and reception circuits are provided with a plurality of time base generators (79, 53) for controlling the advancing of the signal sequence of said logic signal generating means (123).

12. Apparatus for the coding and decoding of electrical signals within a pre-established frequency band and useful for providing communication secrecy, which may be connected between means for the generation and reception of said electrical signals and means for the exchange of said coded signals with at least one other coding and decoding apparatus, comprising a transmission and coding circuit and a reception and decoding circuit for said signals, commutation means for complementarily enabling said transmission and coding circuit and said reception and decoding circuit, said circuits comprising first means for temporarily storing consecutively received portions of said electrical signals, and second means for enabling the operation of said first means to consecutively store in memory said signal portions and to transmit said signal portions, in a different order, to one of said exchange means and said means for the reception of said signals, including third means for controlling the storage of said electrical signal portions in memory within said first means with a sampling frequency selectable between one of a fixed frequency and two or more frequencies variable in a pre-established order.

13. Apparatus according to claim 12, in which said commutation means comprises analog gates (4', 36' and 5, 19) for channeling signals for transmission or reception.

14. Apparatus according to claim 12, in which said first means includes a plurality of memory elements (22'–25', 23–26).

15. Apparatus according to claim 14, in which said memory elements are of the digital type, and further including an analog-to-digital converter (21') and a digital-to-analog converter (33'), respectively located upstream and downstream of said memory elements.

16. Apparatus according to claim 14, in which said memory elements are of the analog type.

17. Apparatus according to claim 14, in which said second means comprises a logic memory (65') within which a plurality of states are stored, which correspond each to one of said memory elements (22', 23', 24', 25') and which evolve according to a coding sequence in said transmission and coding circuit and according to a decoding sequence in said reception and decoding circuit.

18. Apparatus according to claim 17, in which said coding and decoding sequences are cyclically repeated through control of a clock signal and are enabled in a complementary mode through a manual control element (56').

19. Apparatus according to claim 18, in which said commutation means is actuated through said manual control element (56').

20. Apparatus according to claim 18, and including selection means (70') which may be actuated exteriorly for establishing said cyclic sequences and an initial starting state.

21. Apparatus according to claim 20, in which said selection means (70') comprises sealed selector means.

22. Apparatus according to claim 20, in which said selection means comprises punched card means.

23. Apparatus according to claim 20, in which said selection means comprises magnetic card means.

24. Apparatus according to claim 17, including decoding means (30') for decoding the output signals of said logic memory (65'), said decoding means receiving a signal from a manually controlled element (76') for controlling the use of a predetermined one (22') of said memory elements, said predetermined memory element (22') allowing transmission of said electrical signal portions according to the same order in which said signal portions were received.

25. Apparatus according to claim 12, including synchronization signal means for the transmission and the reception in a continuous mode of synchronization signals, said synchronization signal means comprising a generating circuit and a detecting circuit for said synchronization signals, whose operation is enabled in a complementary mode.

26. Apparatus according to claim 25, in which said generating circuit for said synchronization signals comprises a sinusoidal signal synthesizer (97') in which the phase of the sinusoidal signal generated therein is periodically inverted through 180°.

27. Apparatus according to claim 26, in which said synthesizer is formed by a digital-to-analog converter and said phase inversion is obtained by controlling said synthesizer by a clock logic signal from an output of a logic gate (93') of the EX-OR type, said logic gate receiving a clock signal at a first input thereof and a logic signal, alternately at level "0" or "1" with a period equal to the period of said phase inversion, at a second input thereof.

28. Apparatus according to claim 25, in which said first means includes a plurality of memory elements (22', 23', 24', 25'), and further including a band-eliminating filter (11') located upstream of said memory elements.

29. Apparatus according to claim 28, in which said filter (11') attenuates said synchronizing signals and electrical signals whose frequency is near that of said synchronizing signals.

30. Apparatus according to claim 23, in which said filter (11') is of the type comprising a plurality of capacitors having a first armature connected to the input of said filter and a second armature cyclically connected to the output of said filter through an electronic commutator; said filter being further provided with a control input (14') to allow an inversion of said cyclic connection.

31. Apparatus according to claim 30, including an analog switch (20'), with a logic control, located at the output of said filter (11') and actuated during the reception phase and coincidentally with said inversion of said cyclic connection.

32. Apparatus according to claim 12, in which said third means includes a chain of dividers (72) for dividing the frequency of an oscillating signal according to a ratio which is one of fixed frequency and variable between at least two values.

33. Apparatus according to claim 12, including fourth means for the transmission and the reception of synchronizing signals, said fourth means comprising means (95, 96, 97) for generating and modulating said synchronizing signals, a demodulation circuit (10) and a correlation circuit (51).

34. Apparatus according to claim 33, in which said modulation and demodulation means comprise circuits of the FSK type.

35. A coding apparatus according to claim 33, including manually actuatable means (64) for generating a control signal, and control means (60) responsive to said control signal for actuating said commutation means.

36. Apparatus according to claim 35, including second manually actuatable means (65, 66), said control means (60) being responsive to control signals from one ofsaid second manually actuatable means and output signals from said correlation circuit (51), said memory of said first means including a plurality of memory elements (23–26), said correlation circuit signals enabling the use of one memory element (23) of said memory elements, said one memory element (23) providing a transmission of said electric signal portions according to their reception order.

37. Apparatus according to claim 36, including a reception time base generator (53) and a transmission time base generator (79), said correlation circuit (51) generating an output signal coupled directly to said reception time base generator and indirectly to said transmission time base generator through a logic consent gate (54), said logic consent gate receiving further an output signal (82) from said control means (60) sensitive to one state of said apparatus relative to the operation of that apparatus as a main or an enslaved station.

38. Apparatus for the coding and decoding of electrical signals within a pre-established frequency band and useful for providing communication secrecy, which may be connected between means for the generation and reception of said electrical signals and means for the exchange of said coded signals with at least one other coding and decoding apparatus, comprising a transmission and coding circuit and a reception and decoding circuit for said signals, commutation means for complementarily enabling said transmission and coding circuit and said reception and decoding circuit, said circuits comprising first means for temporarily storing consecutively received portions of said electrical signals, and second means for enabling the operation of said first means to consecutively store in memory said signal portions and to transmit said signal portions, in a different order, to one of said exchange means and said means for the reception of said signals, including simplex/duplex communication means (300) for establishing one of simplex and duplex type communication with another coding apparatus and determining the presence of a corresponding simplex/duplex communication means in said another coding apparatus.

39. Apparatus according to claim 38, including further means, enabled by said simplex/duplex communication means and comprising a first oscillator (163) for transmitting a first signal from a transmitting apparatus to a receiving apparatus, and a second oscillator (164) enabled, in said receiving apparatus, by said first signal, to transmit an advising signal to said transmitting apparatus, said first signal locking further in said receiving apparatus the activation of said first oscillator, and said simplex/duplex communication means including means for detecting said signals generated by said oscillators.

40. Apparatus according to claim 39, in which at least one of said first signal and said advising signal are transmitted through the enabling of at least one of said first and second oscillators by manually actuatable means (64).

41. Apparatus according to claim 39, in which said first signal and advising signal are transmitted by the enabling of a gating circuit (156) whose output signal is a function of the presence of said electrical signals.

42. Apparatus according to claim 39, in which said first signal is transmitted by the enabling of a gating circuit (156) whose output signal is a function of the presence of said electrical signals.

* * * * *

UNITED STATES PATENT AND TRADEMARK OFFICE

CERTIFICATE OF CORRECTION

PATENT NO. : 4,217,469

DATED : August 12, 1980

INVENTOR(S) : Emilio Martelli

It is certified that error appears in the above-identified patent and that said Letters Patent are hereby corrected as shown below:

Col. 7, line 54, after "only" insert --one--.

Col. 9, line 27, delete second "or".
line 33, after "54", "and" should read --of--.

Col. 11, line 49, "152" should read --154--.

Col. 15, line 46, "contour" should read --counter--.

Col. 16, line 1, "stages" should read --steps--.

Col. 17, line 4, "synchronizer" should read --synthesizer--;
line 13, "cuase" should read --cause--;
line 34, "receiving" should read --received--.

Col. 19, line 17, "conversion" should read --conversation--.

Claim 30, change the dependency from claim 23 to claim 28.

Claim 36, line 4, "ofsaid" should read --of said--.

Signed and Sealed this

Second Day of June 1981

[SEAL]

Attest:

RENE D. TEGTMEYER

Attesting Officer

Acting Commissioner of Patents and Trademarks